US009737159B2

(12) United States Patent
Lucken et al.

(10) Patent No.: US 9,737,159 B2
(45) Date of Patent: Aug. 22, 2017

(54) ARTICLE DIVIDER DEVICE

(71) Applicants: Ruby Kirin Lucken, Golden, CO (US); Susan Brown Lucken, Golden, CO (US)

(72) Inventors: Ruby Kirin Lucken, Golden, CO (US); Susan Brown Lucken, Golden, CO (US)

( * ) Notice: Subject to any disclaimer, the term of this patent is extended or adjusted under 35 U.S.C. 154(b) by 0 days.

(21) Appl. No.: 15/151,489

(22) Filed: May 11, 2016

(65) Prior Publication Data

US 2017/0007048 A1 Jan. 12, 2017

Related U.S. Application Data

(60) Provisional application No. 62/231,451, filed on Jul. 7, 2015.

(51) Int. Cl.

| | |
|---|---|
| ***A47G 19/02*** | (2006.01) |
| ***B65D 1/36*** | (2006.01) |
| ***B65D 25/06*** | (2006.01) |

(52) U.S. Cl.

CPC ..... *A47G 19/02* (2013.01); *B65D 1/36* (2013.01); *B65D 25/06* (2013.01)

(58) Field of Classification Search

CPC . A47G 19/02; B65D 1/36; B65D 1/34; B65D 25/06; B65D 25/04

USPC ..... 220/575, 574, 532, 530, 529, 556; 206/561, 557; 211/184, 183; 29/525; 99/537; D7/553.6, 553.1, 550.1, 555

See application file for complete search history.

(56) References Cited

U.S. PATENT DOCUMENTS

| | | | | |
|---|---|---|---|---|
| 2,457,875 | A * | 1/1949 | Day | A45C 11/02 206/8 |
| 2,974,820 | A * | 3/1961 | Romei | A47G 19/02 220/529 |
| 5,588,551 | A * | 12/1996 | Morrow | A47G 19/02 220/511 |
| 8,662,340 | B2 * | 3/2014 | Cocchiarella | A47G 19/02 220/521 |
| 8,800,802 | B2 * | 8/2014 | Martin | B65D 85/78 220/529 |
| 2011/0017078 | A1 * | 1/2011 | O'Connell | A47J 27/05 99/448 |
| 2013/0292389 | A1 * | 11/2013 | Jones | A47G 19/02 220/575 |

(Continued)

*Primary Examiner* — Robert J Hicks
(74) *Attorney, Agent, or Firm* — Roger A. Jackson

(57) ABSTRACT

A divider device and method for placement of the device upon a surface to divide a pair of different articles, the divider device includes an extension beam having proximal and distal ends, also having first and second ends, in addition a flexible flange extending outward from the proximal end omni-directionally about the entire beam first and second ends with the flange terminating in a periphery, further the flange having an elongated concave trough surface opposite the extension beam. Operationally the concave trough surface is pressed into direct contact with the surface, thus nearly flattening the concave shape as against the surface to form a substantially fluid tight removable engagement with the surface thus separating the pair of different articles in relation to the surface and the divider device to help prevent communication as between the pair of different articles on the surface.

20 Claims, 9 Drawing Sheets

(56) References Cited

U.S. PATENT DOCUMENTS

2014/0025508 A1* 1/2014 Bartosch ..... B65D 25/04
705/14.69

* cited by examiner

ARTICLE DIVIDER DEVICE

RELATED PATENT APPLICATION

This application claims the benefit of U.S. provisional patent application Ser. No. 62/231,451 filed on Jul. 7, 2015 by Ruby Kirin Lucken of Golden, Colo., U.S. and Susan Brown Lucken of Golden, Colo., U.S.

TECHNICAL FIELD

The present invention relates generally to a divider for an article or a plurality of articles for use with a support surface, wherein the present invention removably engages the support surface. More specifically, the present invention is a flexible divider that removably engages a food plate surface in a substantially fluid tight manner to help prevent different articles of food intermixing with one another, or further to create a stop to scoop the food article against, or also could be used s a gauge for food portion control on the food plate.

BACKGROUND OF INVENTION

Desiring a food plate divider has been around a long time for the above mentioned reasons of preventing different food articles from intermixing, providing a wall to scoop the food article against with a fork or spoon (especially for impaired individuals), or to act as a gauge for setting desired food portion sizes for individual on a diet. Thus the particular structure for creating the food plate divider is the variable, outside of the potential for an integral and permanent divider say molded into the plate, a food plate divider that is "after-market" i.e. being adaptable to existing food plates and of course having desirable features of being easy to securely attach and remove, plus being flexibly adaptable to varying food plate surface contours, and finally washing up well, plus when the divider is attached to the food plate surface to have it be fairly liquid tight to prevent food juices from intermixing as between the different food articles.

Looking at the prior art in the food plate barrier arts, in U.S. Pat. No. 5,588,551 to Morrow, et al., disclosed is an eating aid comprising: a one-piece, integral, elastically deformable member having a top wall and a continuous side wall with a bottom edge surrounding a depression. Wherein in Morrow, the member cooperates with a substantially smooth and planar surface to form a closed chamber when the bottom edge is disposed thereon and adheres to the surface by suction in response to a downward deformation of the top wall and wherein the side wall extends upwardly from the surface when the member is adhered thereto to form an abutment surface with an overhanging lip configured to force food pushed against the abutment surface by an eating utensil onto the utensil when a user is eating food off of the planar surface. Thus Morrow forms a food scoop stop abutment that is symmetrically shaped in the central portion of the plate that is removably engagable from the plate via a conventional suction cup for the abutment to be washed separate from the plate. Note that in Morrow there is no specific structure disclosed to help break the suction cup adherence to the plate or is taught the need for the suction cup to form a water tight barrier due to its triangular shape and functional use.

Continuing, in the prior art in the field of food plate article dividers in U.S. Pat. No. 2,974,820 to Romei, disclosed is a dinner plate comprising an elongated relatively thin vertically upright strip of material, and a conventional suction cup for securing the strip of material in transversely extending relation on the upper surface of a dinner plate, and means for connecting the suction cup to the strip of material, see FIGS. 2 and 5. Romei also has the last-mentioned means comprising an elongated threaded bolt to fixedly secure to the suction cup and extending upwardly therefrom, further a downwardly flared boss integral with the strip of material and having a threaded aperture therein in which the bolt engages, the strip of material having its bottom edge engaging the upper surface of the diner plate. Thus in Romei, the transverse wedge shaped form is with the thickest portion uppermost and generally parallel to the lower edge, the lower edge including an offset portion adjacent one end extending upwardly to a height to accommodate said suction cup with remainder of the lower edge in engagement with the dinner plate, see in particular FIG. 2. Note that in Romei, again there is no specific structure disclosed to help break the suction cup adherence to the plate nor is their structure disclosed to create a liquid tight barrier as between the barrier and the plate and as FIG. 2 shows there is actually a open gap as between the divider and the plate.

Further in the plate food article divider arts in U.S. Pat. No. 8,662,340 to Cocchiarella, disclosed is a removable portion (non-engaged) control device for use with a plate, comprising: a cover member sized to cover at least a portion of the plate. The cover member in Cocchiarella including: a first surface having a plurality of openings therein; a plurality of compartment walls attached to the first surface adjacent to a perimeter of the plurality of openings, the plurality of compartment walls extending a first distance in a first general direction from the first surface; and an outer side wall extending a second distance in the first general direction from the first surface at an outermost perimeter of the first surface.

Wherein the second distance in Cocchiarella is less than the first distance; wherein the plurality of openings and the plurality of compartment walls define a plurality of discrete portion compartments each defined by one opening and one compartment wall; wherein an outer shape of the first surface at the outermost perimeter of the first surface corresponds to an outer shape of the plate at an outermost perimeter of the plate; wherein the plurality of portion compartments cooperate with the plate to define portion sizes; wherein the cover member is configured to be removed from the plate so as to leave any contents of the plurality of portion compartments on the plate. Basically, Cocchiarella is a food portion size gauge that is used to fill the various compartments with food types, such as starch, protein, etc., and then the Cocchiarella food portion gauge is removed, leaving the desired food portions on the plate, thus there is no attachment of the food portion gauge to the plate nor is there concern over fluid exchange as between the different food types at the divider.

Continuing, in the food article divider arts in U.S. Pat. No. 8,800,802 to Martin, disclosed is a stackable container having a selectable or movable (foldable) divider, in a vertical container wall. The vertical container wall in Martin having an outer surface, an inner surface, a top edge, and a bottom edge, the vertical container wall having a horizontal circumference, the horizontal circumference larger at the top edge than at said bottom edge; a bottom container wall, the bottom container wall having a horizontal portion and a vertical portion. The horizontal portion in Martin having an inner surface and an outer surface, wherein the first divider having a front divider surface, a back divider surface, a top divider edge, a bottom divider edge, a first vertical divider edge and a second vertical divider edge; wherein the first divider is fixably attached (to be desirably fluid tight) to the vertical container wall at the first vertical divider edge to form a live hinge and is deployable within the container to provide a partition therein.

Also included in Martin is a second divider, having a front divider surface, a back divider surface, a top divider edge, a bottom divider edge, a first vertical edge and a second vertical edge; wherein the second divider is fixably attached (again to be desirably fluid tight) to the first divider to form a live hinge and is deployable therefrom and within the container to provide a second partition therein; wherein the container may provide one, two, or three partitioned areas for contents placed therein through selected deployment of the first and second dividers. Note that Martin is taught to be a completely disposable paper assembly with no re-usability of any kind, plus the dividers are taught to be permanently attached.

In addition, for the plate food article divider arts in United States Patent Application Publication Number 2013/0292389 to Jones, et al., disclosed is a plate with an integrated design for sauces includes a plate well, a lip, an outer base, a plurality of central bases, at least one design indentation in the plate surface, and a design indentation border within the late surface. The lip in Jones is positioned around the plate well, and the outer base and the plurality of central bases are positioned with the plate well opposite from the lip and at least one design indentation is positioned on the plate well and provides a separate area for the sauces. The design indentation border in Jones provides a barrier between a food surface of the plate well and a top surface of the at least one design indentation is positioned around the at least one design indentation on an opposing side. The plate in Jones with integrated design for sauces allows food items to be served on the food surface while keeping the sauces within the at least one design indentation. Note that Jones teaches a permanent divider that is unmovable requiring a new unique plate.

What is needed is a low cost, compact, and easy to install article divider device that removably engages the food plate surface in a substantially fluid tight manner that is operational to separate different food items from one another. Further the divider should be flexible to adapt to different sizes and shapes of food plates, plus be easily attachable and removable for washing.

SUMMARY OF INVENTION

Broadly, the present invention is a divider device for placement upon a surface to divide a pair of different articles, wherein the divider device includes an extension beam having a longitudinal axis, the extension beam also having a tangential axis that is perpendicularly positioned to the longitudinal axis, further the extension beam having a projection axis that is perpendicularly positioned to the tangential axis. The extension beam additionally including a proximal end portion and an opposing distal end portion with the projection axis spanning therebetween, further the extension beam having a first end portion and an opposing second end portion with the longitudinal axis spanning therebetween and the extension beam also having a first face portion and an opposing second face portion with the tangential axis spanning therebetween.

The divider device further including a flexible flange extending from the proximal end portion, the flexible flange extends parallel to both the longitudinal and tangential axes such that the flexible flange further has an extension in an outward manner that extends omni-directionally beyond the extension beam to terminate in an outer periphery relative to the proximal end portion. The flange having a primary surface oppositely positioned to the extension beam, the flange also having a secondary surface that is oppositely positioned to the primary surface, the primary surface having a concave shape that is juxtapose to both of the tangential and longitudinal axes, wherein the concave shape forms an elongated depression trough that is elongated along the longitudinal axis.

Wherein operationally, the primary surface is pressed into direct contact with the surface, thus substantially flattening the concave shape as against the surface to form a removable engagement as between the flange and the surface thus forming a substantially fluid tight interface between the flange and the surface that extends beyond the extension beam first and second end portions along the longitudinal axis and the flange extending beyond the extension beam first and second face portions to help prevent a one of the articles from communicating between the extension beam, the flange, and the surface to another article on the surface that is positioned opposite the other article in relation to the extension beam.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
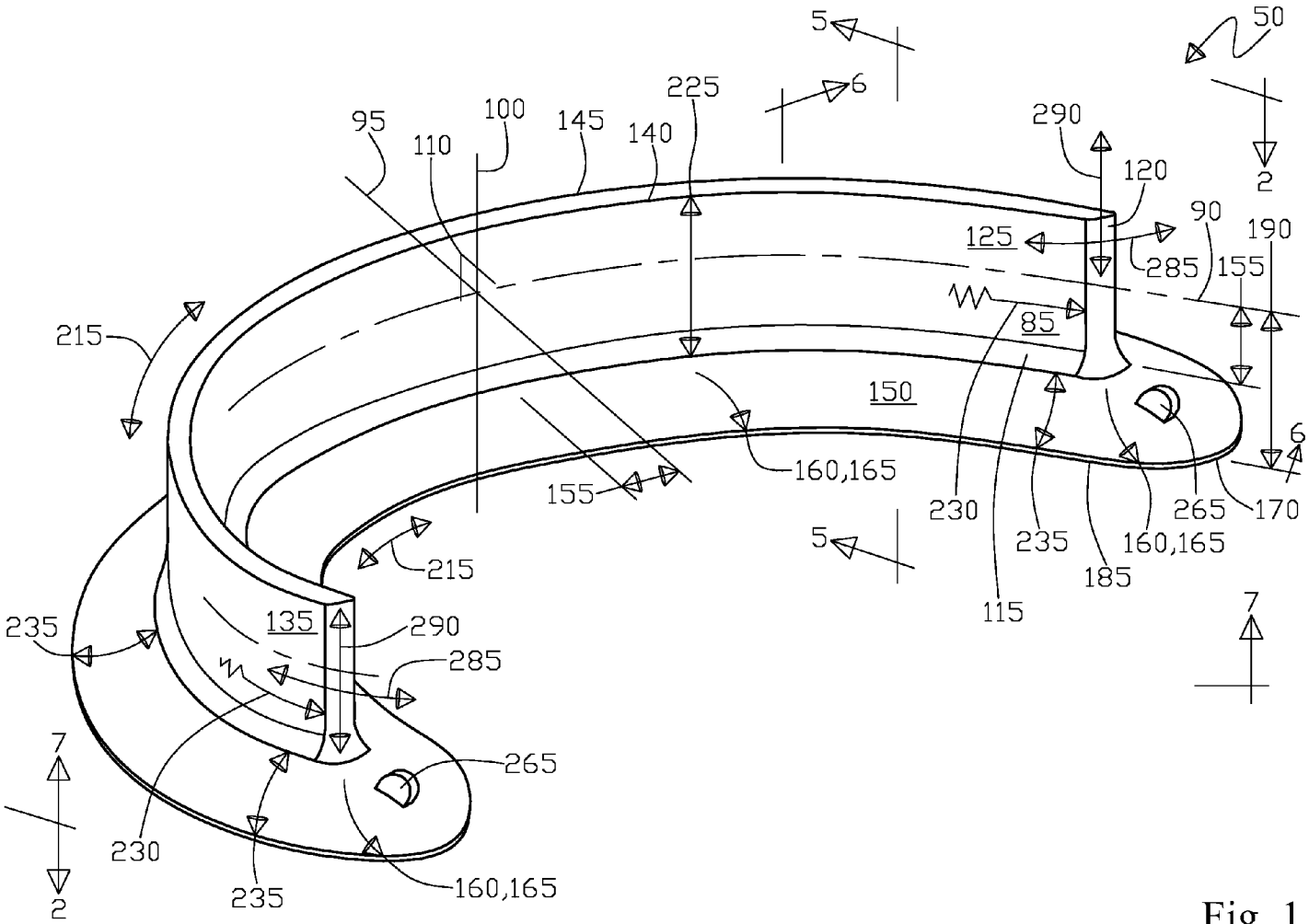
FIG. 1 shows an upper perspective view of the divider device that includes an extension beam with a longitudinal axis, tangential axis, and a projection axis, with a proximal end portion and a distal end portion, along with a first end portion and a second end portion, plus a first face portion and second face portion, in addition shown is a flexible flange that extends in an outward manner from the proximal end portion, wherein the flexible flange has a primary surface (not shown), a secondary surface, and an outer periphery, wherein the secondary surface has a pair of protrusions.

50 Divider device
55 Surface
60 Food plate surface
65 Articles
70 First food item
75 Second food item
80 Coalesced shape of the article 65, 70
85 Extension beam
90 Longitudinal axis of the extension beam 85
95 Tangential axis of the extension beam 85
100 Projection axis of the extension beam 85
105 Perpendicular position between the tangential 95 and longitudinal 90 axes
110 Perpendicular position between the tangential 95 and projection 100 axes
115 Proximal end portion of the extension beam 85
120 Distal end portion of the extension beam 85
125 First end portion of the extension beam 85
135 Second end portion of the extension beam 85
140 First face portion of the extension beam 85
145 Second face portion of the extension beam 85
150 Flexible flange
155 Extending parallel to both the longitudinal 90 and tangential 95 axes of the flexible flange 150
160 Extension in an outward manner beyond the extension beam 85 of the flexible flange 150
165 Extends omni-directionally beyond the extension beam 85 of the flexible flange 150
170 Outer periphery of the flexible flange 150
175 Primary surface of the flexible flange 150
180 Secondary surface of the flexible flange 150
185 Concave shape of the primary surface 175
190 Juxtapose position of the concave shape 185 to the tangential 95 and longitudinal axes 90
195 Elongated depression trough of the primary surface 175 formed from the concave shape 185
200 Pressed into contact as between the concave shape 185 and the surface 55
205 Substantially flattening the concave shape 185 against the surface 55
206 Removable engagement between the primary surface 175 and the surface 55
210 Substantially fluid tight interface as between the flange 150 and the surface 55
215 Arcuate shape of the longitudinal axis 90, extension beam 85, and the flexible flange 150 for the divider device 50
220 Annular shape of the elongated depression trough 195
225 First distance between the proximal 115 and distal 120 end portions
230 Second distance between the first 125 and second 135 end portions
235 Third distance that omni-directionally emanates 165 from the proximal end portion 115 for the flexible flange 150 outward manner extension 160
240 Surface area of the primary surface 175
245 Fourth distance as between the primary 175 and secondary 180 surface
250 First full radius of the outer periphery 170
255 Second radius of the concave shape 185
260 Mirror polish surface finish of the concave shape 185

265 Protrusion on the secondary surface 180

270 Manual grasping point of the protrusion 265

275 Manual pulling movement of the protrusion 265 to remove the removable engagement 206 of the flexible flange 150 on the extension beam 85 for the divider device 50

280 Flat portion of the primary surface 175 that is adjacent to the outer periphery 170

285 Stiffness in units of force per distance that is in a plane formed by the longitudinal 90 and tangential 95 axes

290 Stiffness in units of force per distance that is in a plane formed by the longitudinal 90 and projection 100 axes

295 Placing the first food item 70 to be disposed within the arcuate shape 215 of the divider device 50 on the food plate surface 60

300 Placing the second food item 75 to be disposed outside the arcuate shape 215 of the divider device 50 on the food plate surface 60

DETAILED DESCRIPTION

With initial reference to FIG. 1, shown is an upper perspective view of the divider device 50 that includes an extension beam 85 with a longitudinal axis 90, tangential axis 95, and a projection axis 100, with a proximal end portion 115 and a distal end portion 120, along with a first end portion 125 and a second end portion 135. Further FIG. 1 shows a first face portion 140 and second face portion 145, in addition shown is a flexible flange 150 that extends in an outward manner 160 from the proximal end portion 115, wherein the flexible flange 150 has a primary surface 175 (not shown), a secondary surface 180, and an outer periphery 170, wherein the secondary surface 180 has a pair of protrusions 265.

Figure 2:
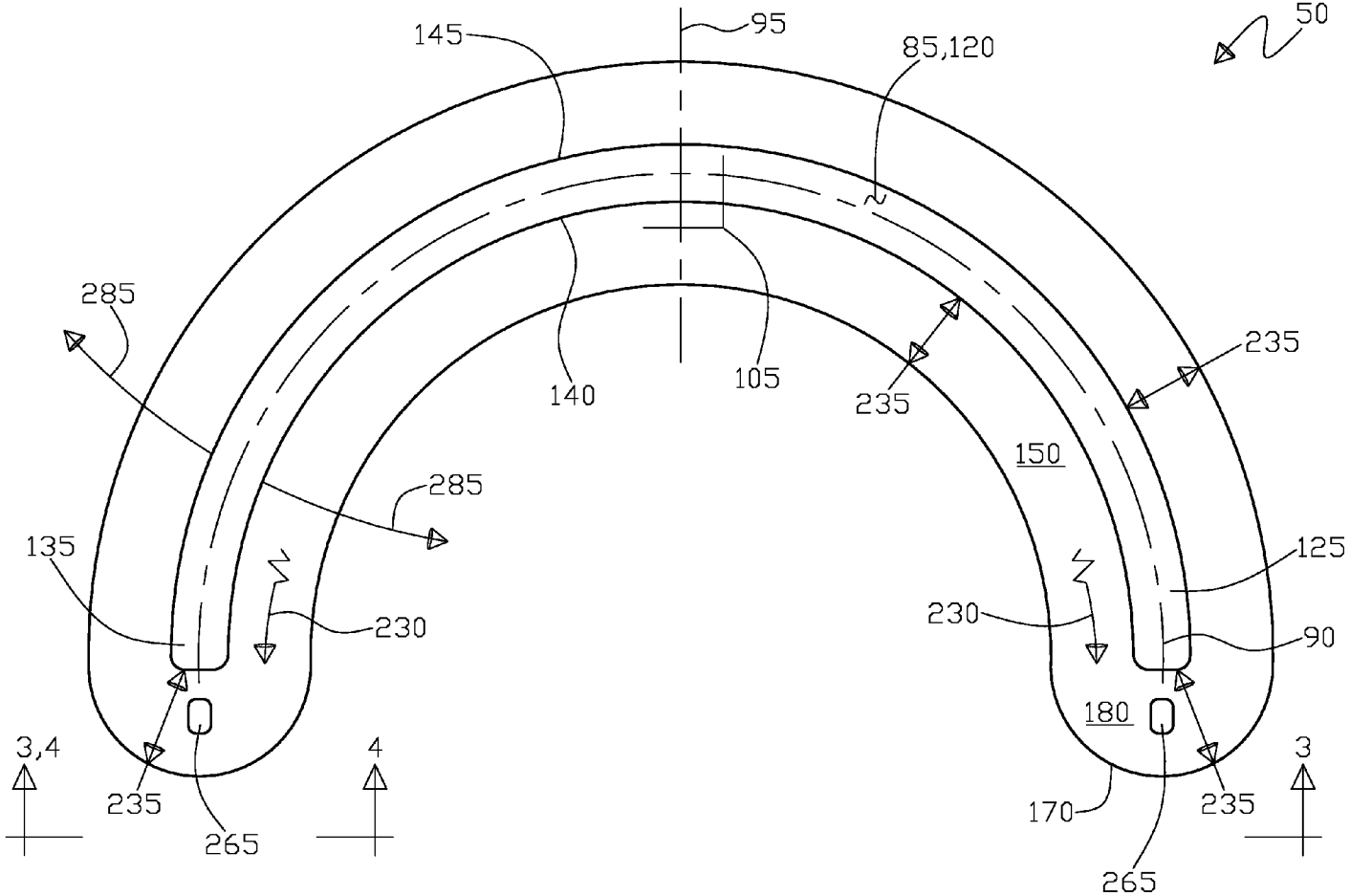
FIG. 2 shows an overhead plan view of the divider device that includes the extension beam with the longitudinal axis and the tangential axis, with the distal end portion, along with the first end portion and the second end portion, plus the first face portion and the second face portion, in addition shown is the flexible flange that extends in the outward manner from the extension beam, wherein the flexible flange has the primary surface (not shown), the secondary surface, and the outer periphery, wherein the secondary surface has the pair of protrusions.

Continuing, FIG. 2 shows an overhead plan view of the divider device 50 that includes the extension beam 85 with the longitudinal axis 90 and the tangential axis 95, with the distal end portion 120, along with the first end portion 125 and the second end portion 135, plus the first face portion 140 and the second face portion 145. In addition, FIG. 2 shows the flexible flange 150 that extends in the outward manner 160 from the extension beam 85, wherein the flexible flange 150 has the primary surface 175 (not shown), the secondary surface 180, and the outer periphery 170, wherein the secondary surface 180 has the pair of protrusions 265.

Figure 3:
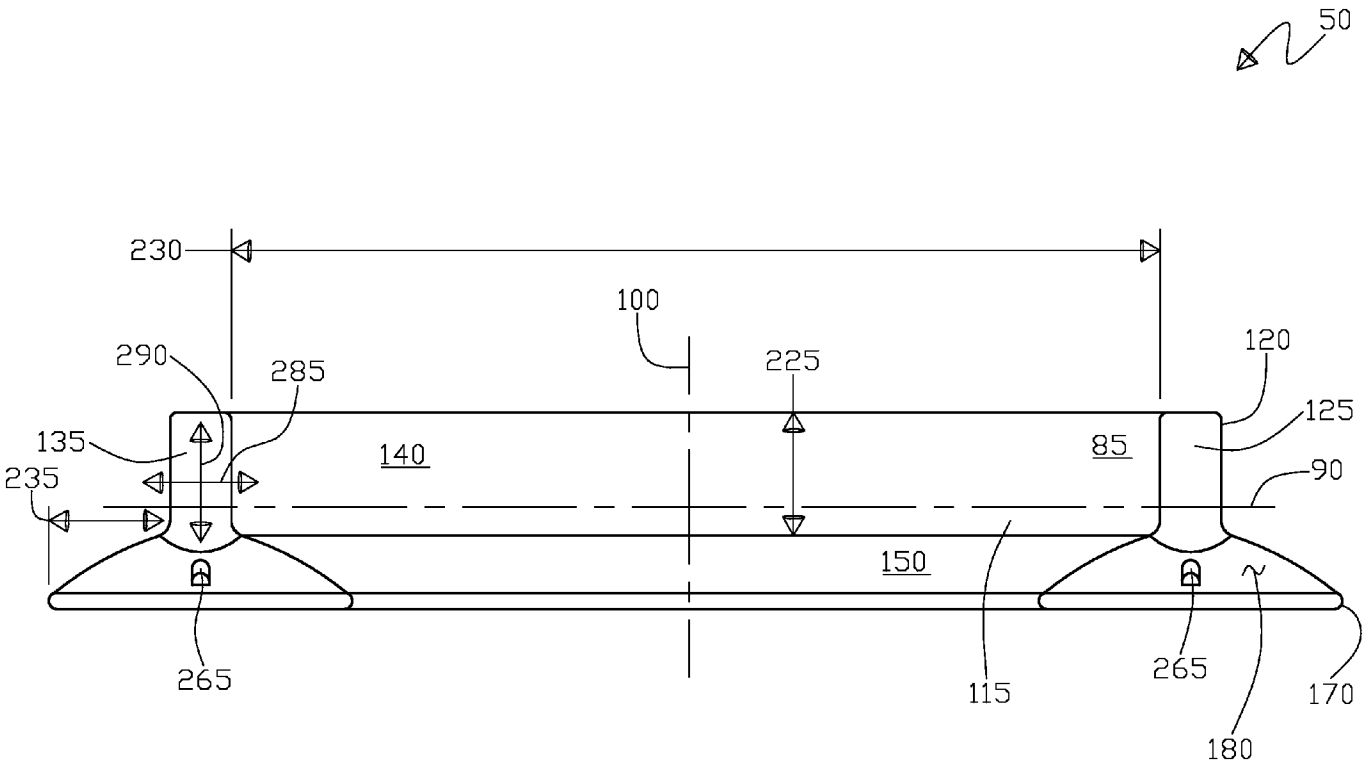
FIG. 3 shows view 3-3 from FIG. 2 that is a side elevation view of the divider device, wherein FIG. 3 includes the extension beam with the longitudinal axis and the projection axis, with the proximal end portion and the distal end portion, along with the first end portion and the second end portion, plus the first face portion, in addition shown is the flexible flange that extends in the outward manner from the proximal end portion, wherein the flexible flange has the primary surface (not shown), the secondary surface, and the outer periphery, wherein the secondary surface has the pair of protrusions.

Next, FIG. 3 shows view 3-3 from FIG. 2 that is a side elevation view of the divider device 50, wherein FIG. 3 includes the extension beam 85 with the longitudinal axis 90 and the projection axis 100, with the proximal end portion 115 and the distal end portion 120, along with the first end portion 125 and the second end portion 135. Also, FIG. 3 has the first face portion 140, in addition shown is the flexible flange 150 that extends in the outward manner 160 from the proximal end portion 115, wherein the flexible flange 150 has the primary surface 175 (not shown), the secondary surface 180, and the outer periphery 170, wherein the secondary surface 180 has the pair of protrusions 265.

Figure 4:
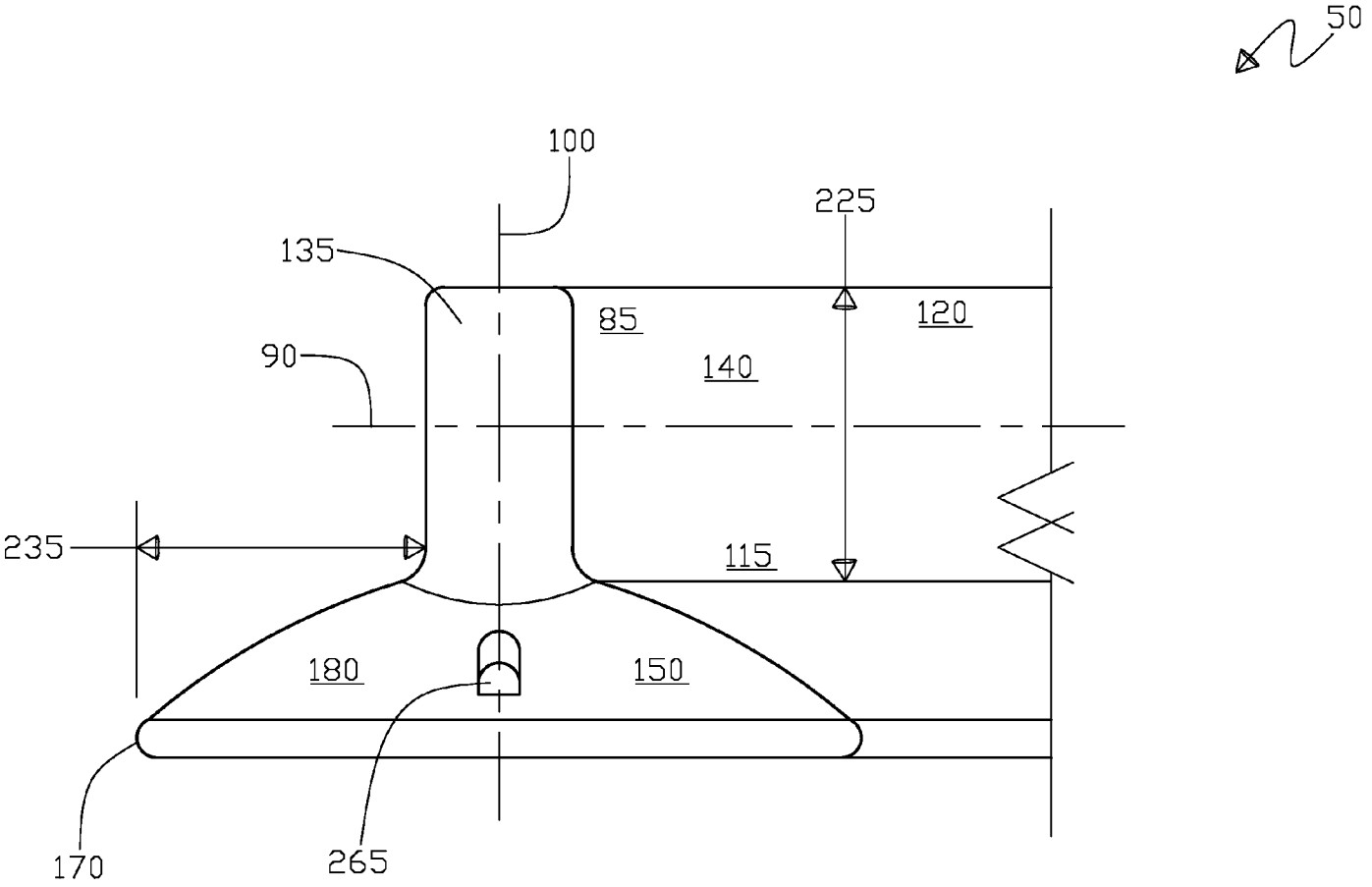
FIG. 4 shows view 4-4 from FIG. 2 that is an end elevation view of the divider device, wherein FIG. 4 includes the extension beam with the longitudinal axis and the projection axis, with the proximal end portion and the distal end portion, along with the second end portion, plus the first face portion, in addition shown is the flexible flange that extends in the outward manner from the proximal end portion, wherein the flexible flange has the primary surface (not shown), the secondary surface, and the outer periphery, wherein the secondary surface has the protrusion.

Further FIG. 4 shows view 4-4 from FIG. 2 that is an end elevation view of the divider device 50, wherein FIG. 4 includes the extension beam 85 with the longitudinal axis 90 and the projection axis 100, with the proximal end portion 115 and the distal end portion 120, along with the second end portion 135. In addition, FIG. 4 shows the first face portion 140, in addition shown is the flexible flange 150 that extends in the outward manner 160 from the proximal end portion 115, wherein the flexible flange 150 has the primary surface 175 (not shown), the secondary surface 180, and the outer periphery 170, wherein the secondary surface 180 has the protrusion 265.

Figure 5:
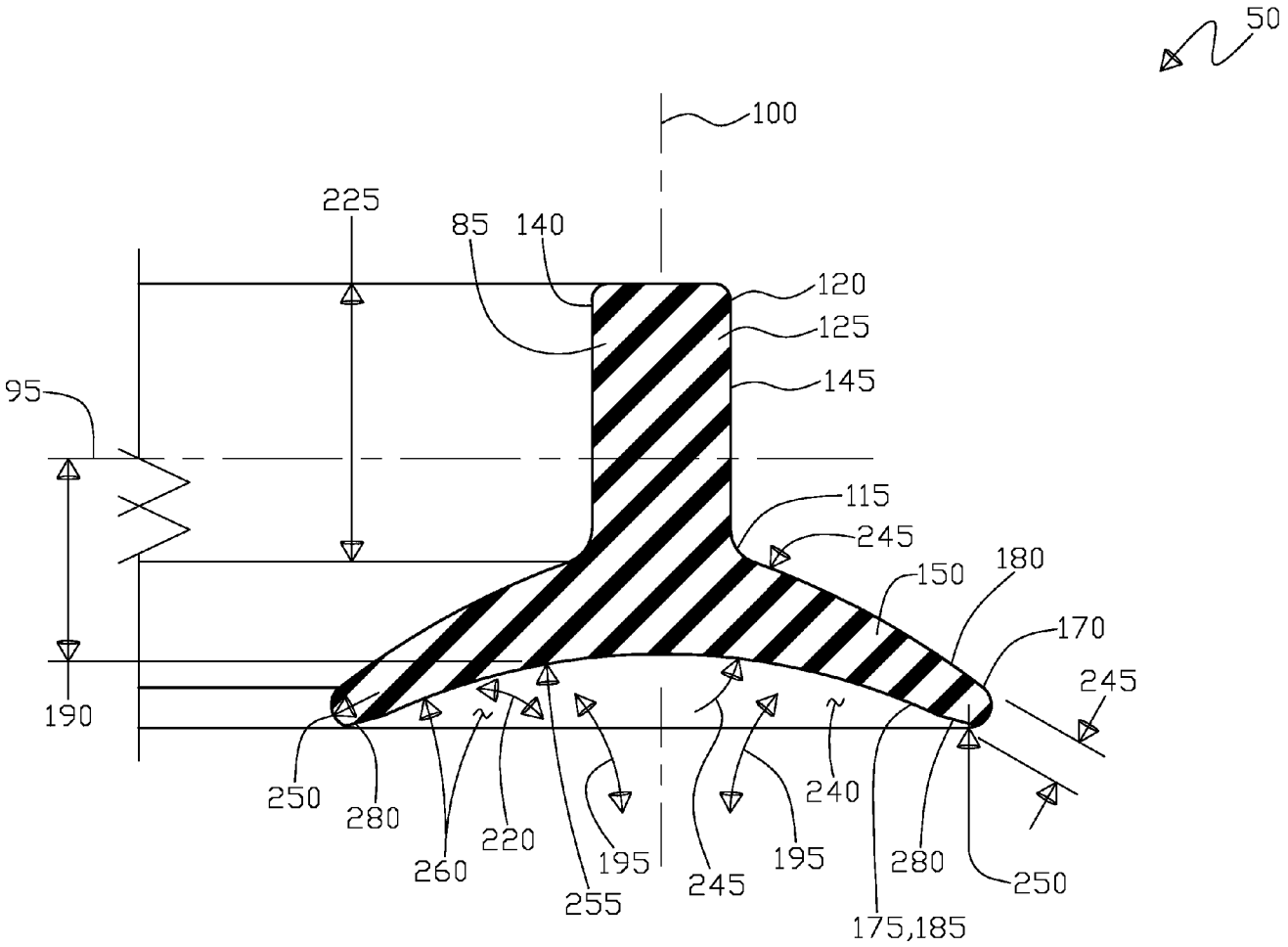
FIG. 5 shows cross section cut view 5-5 from FIG. 1 that is a cross sectional view of the divider device, wherein FIG. 5 includes the extension beam with the tangential axis and the projection axis, with the proximal end portion and the distal end portion, along with the first end portion, plus the first face portion and the second face portion, in addition shown is the flexible flange that extends in the outward manner from the proximal end portion, wherein the flexible flange has the primary surface with a concave shape, the secondary surface, and the outer periphery.

Moving onward, FIG. 5 shows cross section cut view 5-5 from FIG. 1 that is a cross sectional view of the divider device 50, wherein FIG. 5 includes the extension beam 85 with the tangential axis 95 and the projection axis 100, with the proximal end portion 115 and the distal end portion 120, along with the first end portion 125. FIG. 5 further shows the first face portion 140 and the second face portion 145, in addition shown is the flexible flange 150 that extends in the outward manner 160 from the proximal end portion 115, wherein the flexible flange 150 has the primary surface with a concave shape 185, the secondary surface 180, and the outer periphery 170.

Figure 6:
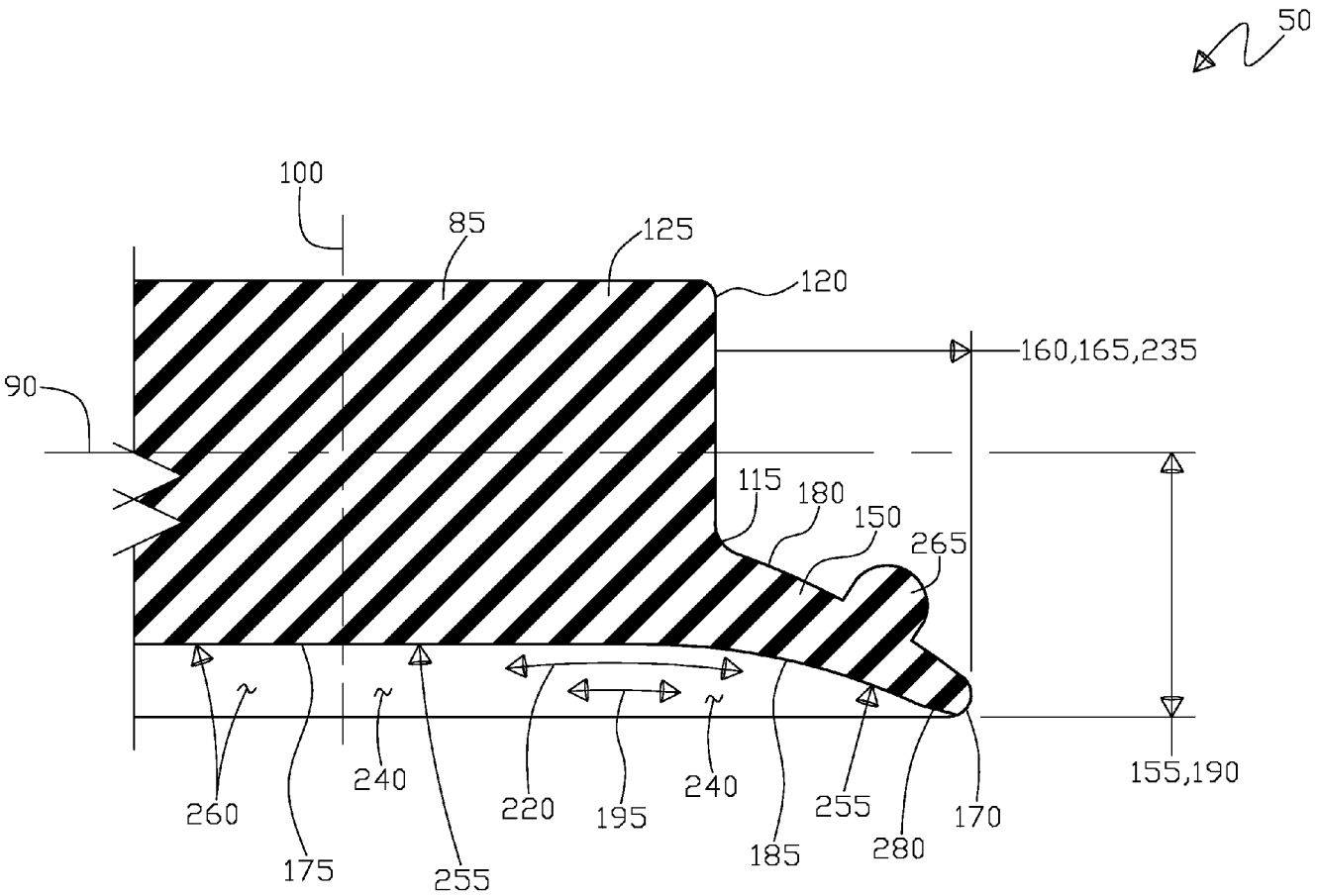
FIG. 6 shows view 6-6 from FIG. 1 that is a longitudinal cross sectional cut section view of the divider device, wherein FIG. 6 includes the extension beam with the longitudinal axis and the projection axis, with the proximal end portion and the distal end portion, along with the first end portion, in addition shown is the flexible flange that extends in the outward manner from the proximal end portion, wherein the flexible flange has the primary surface with the concave shape, the secondary surface, and the outer periphery, wherein the secondary surface has the protrusion.

Next, FIG. 6 shows view 6-6 from FIG. 1 that is a longitudinal cross sectional cut section view of the divider device 50, wherein FIG. 6 includes the extension beam 85 with the longitudinal axis 90 and the projection axis 100, with the proximal end portion 115 and the distal end portion 120, along with the first end portion 125. FIG. 6, in addition shows the flexible flange 150 that extends in the outward manner 160 from the proximal end portion 115, wherein the flexible flange 150 has the primary surface 175 with the concave shape 185, the secondary surface 180, and the outer periphery 170, wherein the secondary surface 180 has the protrusion 265.

Figure 7:
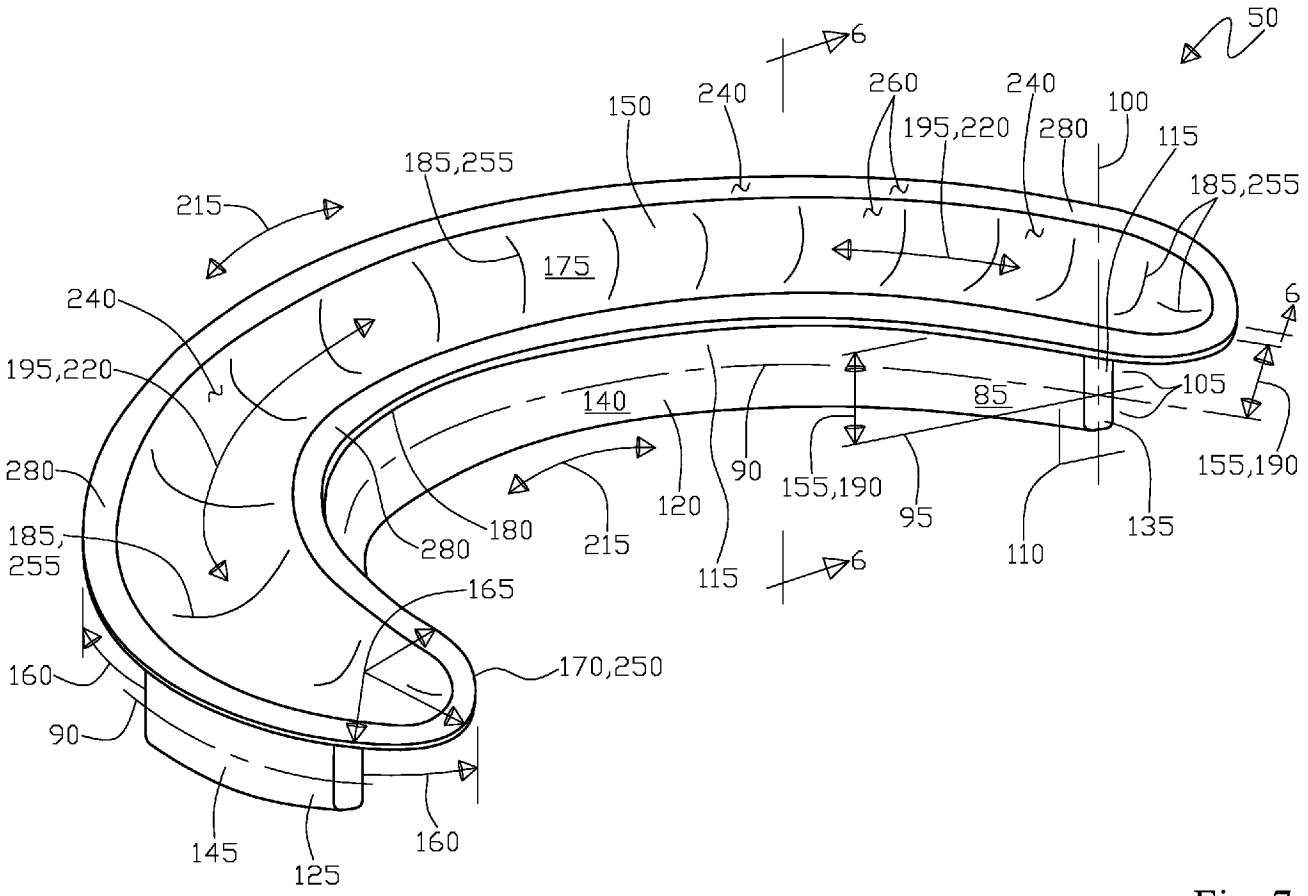
FIG. 7 shows view 7-7 from FIG. 1 that is an underside perspective view of the divider device, wherein FIG. 7 includes the extension beam with the longitudinal axis, the tangential axis, and the projection axis, with the proximal end portion and the distal end portion, along with the first end portion and the second end portion, plus the first face portion and the second face portion, in addition shown is the flexible flange that extends in the outward manner from the proximal end portion, wherein the flexible flange has the primary surface with the concave shape that forms an elongated depression trough that is in an annular shape, a flat portion of the primary surface, the secondary surface, and the outer periphery.

Continuing, FIG. 7 shows view 7-7 from FIG. 1 that is an underside perspective view of the divider device 50, wherein FIG. 7 includes the extension beam 85 with the longitudinal axis 90, the tangential axis 95, and the projection axis 100, with the proximal end portion 115 and the distal end portion 120, along with the first end portion 125 and the second end portion 135, plus the first face portion 140 and the second face portion 145. Also, FIG. 7 shows in addition the flexible flange 150 that extends in an outward manner 160 from the proximal end portion 115, wherein the flexible flange 150 has the primary surface 175 with the concave shape 185 that forms an elongated depression trough 195 that is in an annular shape 220, a flat portion 280 of the primary surface 175, the secondary surface 180, and the outer periphery 170.

Figure 8:
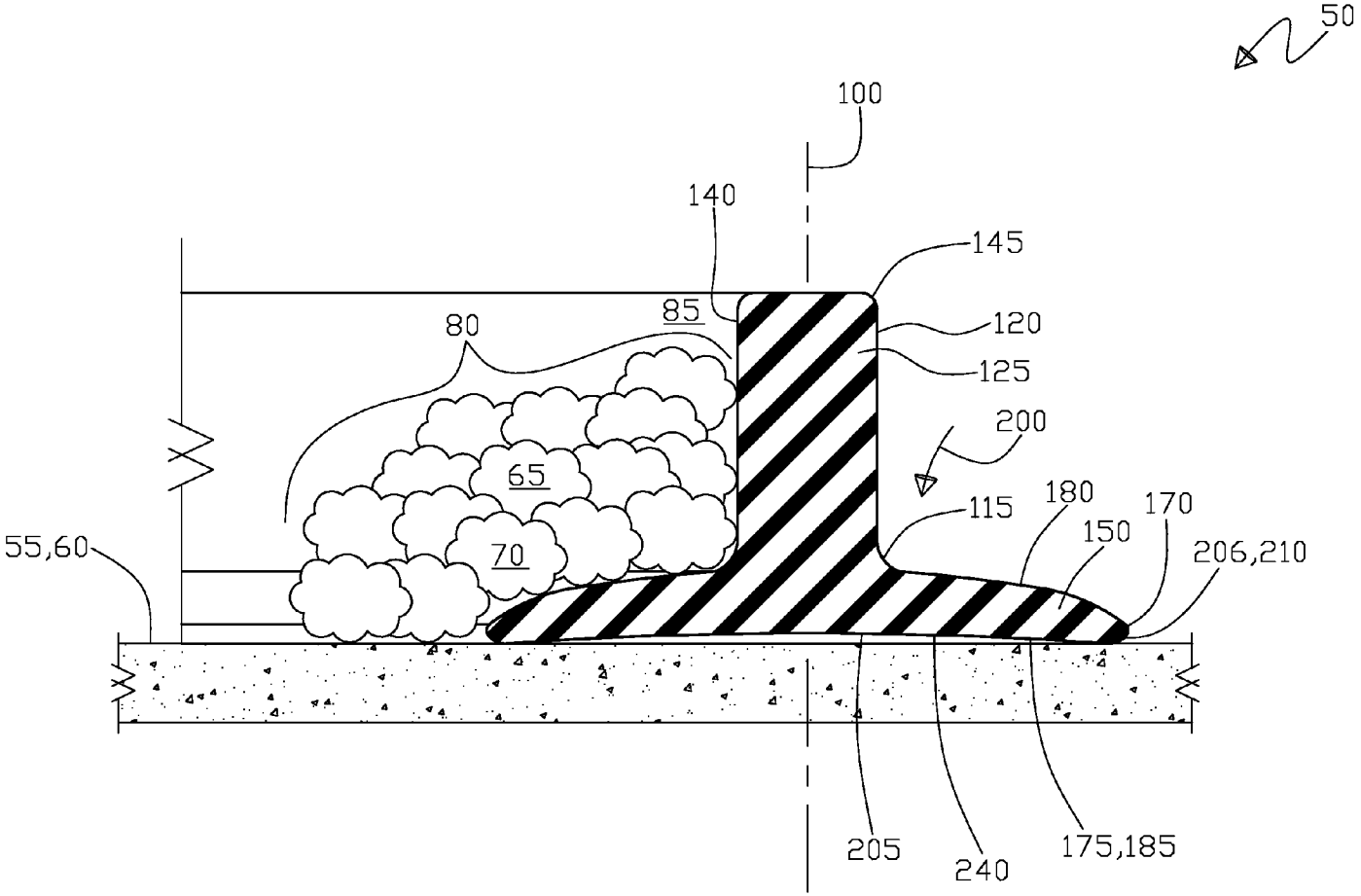
FIG. 8 shows cross section cut view 8-8 from FIG. 9 that is a cross sectional view of the divider device in use and installed in place on a surface or food plate surface, with the divider device holding the article or first food item coalesced in place against the divider device and surface, wherein FIG. 8 basically depicts FIG. 5 with the concave shape pressed and flattened into contact with the surface to form a removable engagement between the divider device and the surface that is substantially fluid tight, FIG. 8 also shows the extension beam with the projection axis, with the proximal end portion and the distal end portion, along with the first end portion, plus the first face portion and the second face portion, in addition shown is the flexible flange that extends in the outward manner from the proximal end portion, wherein the flexible flange has the primary surface with the flattened concave shape, the secondary surface, and the outer periphery.
Figure 9:
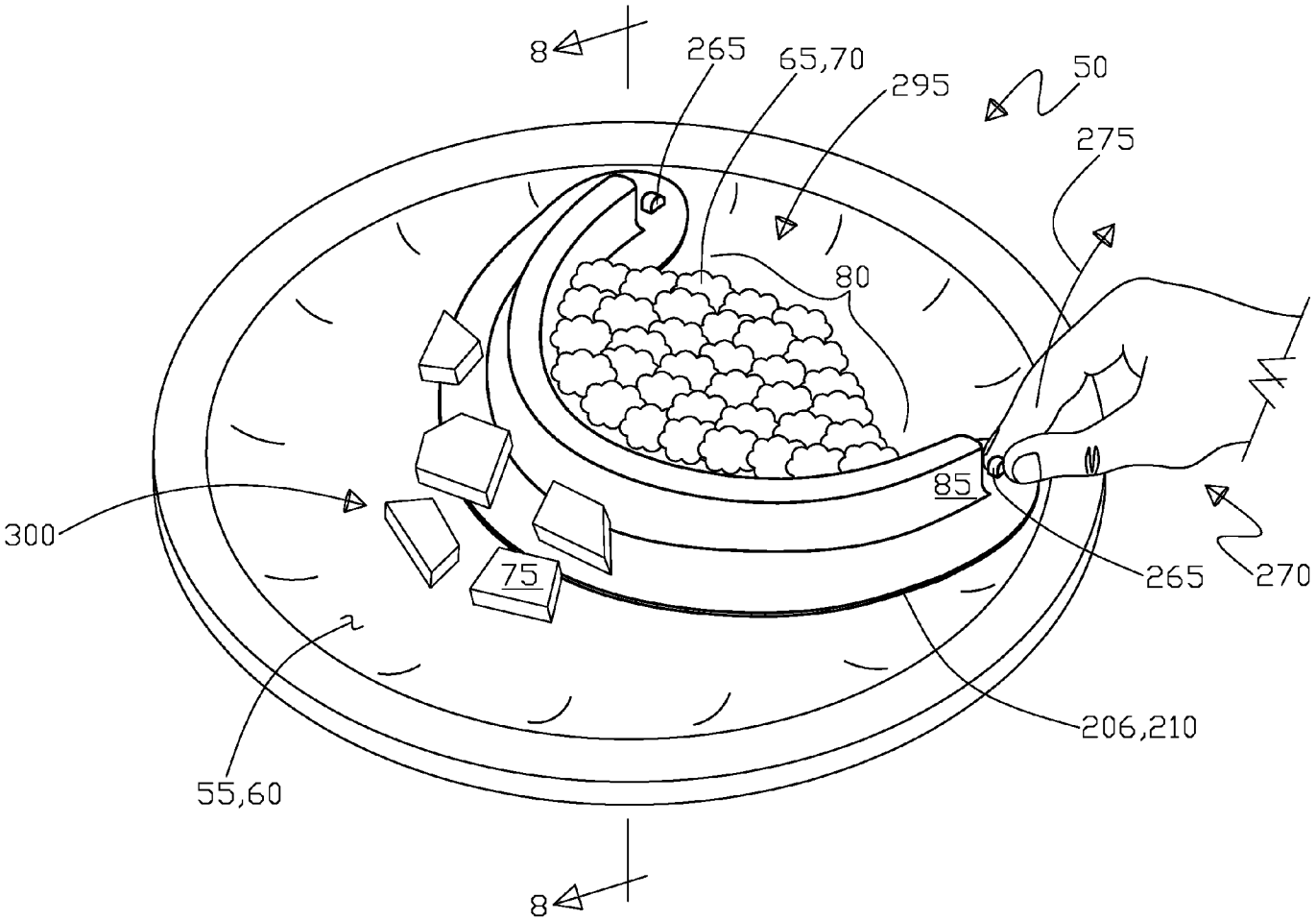
FIG. 9 shows upper perspective view of the divider device in use and installed in place on the surface or the food plate surface, with the divider device holding the article or first food item coalesced in place against the divider device and surface, with the concave shape pressed and flattened into contact with the surface to form a removable engagement between the divider device and the surface that is substantially fluid tight, as shown in FIG. 8, wherein the divider device in FIG. 9 is shown separating the first food item from a second food item such that fluid communication along the surface under the concave shape is substantially precluded (see FIG. 8) thus keeping the first and second food items separate, also shown is the grasping of the protrusion on the flexible flange with manual pulling movement to break the flattening of the concave shape thus opening the removable engagement via un-flattening the concave shape to remove the divider device from the surface.

Moving onward, FIG. 8 shows cross section cut view 8-8 from FIG. 9 that is a cross sectional view of the divider device 50 in use and installed in place on a surface 55 or food plate surface 60, with the divider device 50 holding the article 65 or first food item 70 coalesced 80 in place against the divider device 50 and surface 55. Wherein FIG. 8 basically depicts FIG. 5 with the concave shape 185 pressed 200 and flattened 205 into contact with the surface 55 to form a removable engagement 206 between the divider device 50 and the surface 55 that is substantially fluid tight 210. FIG. 8 also shows the extension beam 85 with the projection axis 100, with the proximal end portion 115 and the distal end portion 120, along with the first end portion 125, plus the first face portion 140 and the second face portion 145, in addition shown is the flexible flange 150 that extends in the outward manner 160 from the proximal end portion 115, wherein the flexible flange 150 has the primary surface 175 with the flattened 205 concave shape 185, the secondary surface 180, and the outer periphery 170.

Further, FIG. 9 shows upper perspective view of the divider device 50 in use and installed in place on the surface 55 or the food plate surface 60, with the divider device 50 holding the article 65 or first food item 70 coalesced 80 in place against the divider device 50 and surface 55, with the concave shape 185 pressed 200 and flattened 205 into contact with the surface 55 to form a removable engagement 206 between the divider device 50 and the surface 55 that is substantially fluid tight 210, as shown in FIG. 8. Thus in FIG. 9 the divider device 50 is shown separating the first food item 70 from a second food item 75 such that fluid communication 210 along the surface 55 under the concave shape 185 is substantially precluded (see FIG. 8) thus keeping the first 70 and second 75 food items separate. Also shown in FIG. 9 is the grasping 270 of the protrusion 265 on the flexible flange 150 with manual pulling movement 275 to break the flattening 205 of the concave shape 185 thus opening the removable engagement 206 via un-flattening the concave shape 185 to remove the divider device 50 from the surface 55, essentially going from FIG. 8 to FIGS. 5 and 6.

Broadly, the present invention of the divider device 50 is for placement upon the surface 55 to divide a pair of different articles 65, as best shown in FIGS. 8 and 9. Wherein the divider device 50 includes an extension beam 85 having the longitudinal axis 90, the extension beam 85 also having the tangential axis 95 that is perpendicularly positioned 105 to the longitudinal axis 90, further the extension beam 85 having the projection axis 100 that is perpendicularly positioned 110 to the tangential axis 95, see FIGS. 1, 2, and 7. The extension beam 85 additionally including the proximal end portion 115 and the opposing distal end portion 120 with the projection axis 100 spanning therebetween, further the extension beam 85 having the first end portion 125 and the opposing second end portion 135 with the longitudinal axis 90 spanning therebetween and the extension beam 85 also having the first face portion 140 and the opposing second face portion 145 with the tangential axis 95 spanning therebetween, see in particular FIGS. 1 to 7 and in particular FIG. 1.

The divider device further including a flexible flange 150 extending from the proximal end portion 115, the flexible flange 150 extends parallel 155 to both the longitudinal 90 and tangential 95 axes such that the flexible flange 150 further has an extension 160 in an outward manner that extends omni-directionally 165 beyond the extension beam 85 to terminate in an outer periphery 170 relative to the proximal end portion 115, as best shown in FIGS. 1 and 7, also see FIGS. 3 to 6, and 8. The flange 150 having the primary surface 175 oppositely positioned to the extension beam 85, the flange 150 also having the secondary surface 180 that is oppositely positioned to the primary surface 175, the primary surface 175 having the concave shape 185 that is juxtapose 190 to both of the tangential 95 and longitudinal 90 axes, wherein the concave shape 185 forms the elongated depression 195 trough that is elongated along the longitudinal axis 95, again see FIGS. 1 and 7, also see FIGS. 3 to 6, and 8.

Wherein operationally the primary surface 175 is pressed 200 into direct contact with the surface 55, thus substantially flattening 205 the concave shape 185 as against the surface 55 to form the removable engagement 206 as between the flange 150 and the surface 55 thus forming the substantially fluid tight interface 210 between the flange 150 and the surface 55 that extends 160 beyond the extension beam 85 first 125 and second 135 end portions along the longitudinal axis 90 and the flange 150 extending 160 beyond the extension beam 85 first 140 and second 145 face portions to help prevent a one of the articles 65 from communicating between the extension beam 85, the flange 150, and the surface 55 to another article 65 on the surface 55, as be shown in FIGS. 8 and 9.

As an option for the divider device 50 the longitudinal axis 90 has an arcuate shape 215 wherein the extension beam 85 has an arcuate shape 215 and the flexible flange 150 also follows the extension beam 85 arcuate shape 215 such that the divider device 50 has an arcuate shape 215 along the longitudinal axis 90 further resulting in the elongated depression trough 195 having the annular shape 220, see in particular FIGS. 1, 2, and 7. Wherein operationally, the arcuate shape 215 of the extension beam 85 and the flexible flange 150 further helps the article 65 maintain the coalesced shape 80 as against the extension beam 85, the flexible flange 150, and the surface 55 as best shown in FIGS. 8 and 9.

A further option for the divider device 50 wherein the extension beam 85 can have an aspect ratio of about eight percent (8%) being defined as a first distance 225 between the proximal end portion 115 and the distal end portion 120 in relation to a second distance 230 between the first 125 and second 135 end portions to operationally divide the pair of articles 65 while not forming an obstructive barrier between the pair of articles 65, see in particular FIG. 1 for the aspect ratio, plus FIGS. 8 and 9 for the use of the aspect ratio in relation to the surface 55 and article 65.

Another option for the divider device 50 wherein the flexible flange 150 outward manner extension 160 can be further defined by a peripheral elongated continuous third distance 235 omni-directionally emanating 165 from the proximal end portion 115 that is at least seventy percent (70%) of the first distance 225 to provide an adequate surface area 240 of the primary surface 175 for the removable engagement 206, again see FIG. 1 in particular, plus FIGS. 2 to 7.

A further option for the divider device 50 wherein the flexible flange 150 can have a tapering fourth distance 245 as between the primary 175 and secondary 180 surfaces that is about twenty percent (20%) of the third distance 235 at the proximal end portion 115 to about six percent (6%) of the third distance 235 at the outer periphery 170 to accommodate the flattening 205 of the concave shape 185, as best shown in FIGS. 5 and 8, this through testing a range of fourth distances 245 to better enable both the removable engagement 206 and the substantially fluid tight interface 210 given the flange 150 flexibility.

As a continuing option for the divider device 50 wherein the outer periphery 170 can be formed from a first full radius 250 disposed as between the primary 175 and secondary 180 surfaces that is about three percent (3%) of the third distance 235 to operationally give adequate rigidity to the outer periphery 170 to help the removable engagement 206, again see FIGS. 5 and 8, also through testing the full radius 250 represents flange 150 fourth distance 245 thickness at the outer periphery 170 that provides the right amount of stiffness for effectuating both the removable engagement 206 and the substantially fluid tight interface 210 given the flange 150 flexibility while facilitating the breaking of the removable engagement 206 via the protrusion 265 being manually grasped 270 and pulled 275 as shown in FIG. 9, also see FIGS. 1 to 4, and 6.

As a further alternative for the divider device 50 wherein the concave shape 185 is formed from a second radius 255 that is about three times (3×) of the third distance 235 to operationally help the removable engagement 206, see in particular FIGS. 5 and 6. The second radius 255 is optimized dimensionally to provide the right amount of stiffness for effectuating both the removable engagement 206 and the substantially fluid tight interface 210 given the flange 150 flexibility while facilitating the breaking of the removable engagement 206 via the protrusion 265 being manually grasped 270 and pulled 275 as shown in FIG. 9, also see FIGS. 1 to 4, and 6.

A continuing alternative for the divider device 50 wherein the concave shape 185 or primary surface 175 can have a mirror polish surface finish 260 of no more than about one micro meter (1 μm) average roughness (Ra) to further accommodate the removable engagement 206, see in particular FIG. 7. This mirror polish 260 basically further makes both the removable engagement 206 and the substantially fluid tight interface 210 desirably function given the flange 150 flexibility.

Another alternative for the divider device 50 wherein the flexible flange 150 can have a hardness of about Shore A scale forty to forty five (40-45) to further accommodate the removable engagement 206. The Shore A scale hardness of about 40-45 is optimized to provide the right amount of stiffness for effectuating both the removable engagement 206 and the substantially fluid tight interface 210 given the flange 150 flexibility while facilitating the breaking of the removable engagement 206 via the protrusion 265 being manually grasped 270 and pulled 275 as shown in FIG. 9, also see FIGS. 1 to 4, and 6.

Continuing on the alternatives for the divider device 50 wherein the divider device 50 is preferably constructed of a one piece silicone unit with the extension beam 85 and the flange 150 being integral to one another, for the purpose of flexibility, durability, washability, compatibility with the food articles 70, 75, and effectuating the desired removable engagement 206.

A next alternative for the divider device 50 wherein the flexible flange 150 secondary surface 180 can further comprise the protrusion 265 that is operational to provide a manual grasping point 270 to remove via pulling 275 the flexible flange 150 from the surface 55. Thus the protrusion 265 facilitates the breaking of the removable engagement 206 via the protrusion 265 being manually grasped 270 and pulled 275 as shown in FIG. 9, also see FIGS. 1 to 4, and 6.

A further alternative for the divider device 50 wherein the primary surface 175 can have the flat portion 280 that is adjacent to the outer periphery 170, wherein the flat portion 280 is about six percent (6%) of the third distance 235 at the outer periphery 170 wherein the flat portion 280 is positioned inward from the outer periphery 170 to further accommodate the removable engagement 206, see in particular FIG. 7 and FIGS. 5 and 6. The flat portion 280 is optimized dimensionally to provide the right amount of surface area 240 contact with the surface 55 for effectuating both the removable engagement 206 and the substantially fluid tight interface 210 given the flange 150 flexibility while facilitating the breaking of the removable engagement 206 via the protrusion 265 being manually grasped 270 and pulled 275 as shown in FIG. 9, also see FIGS. 1 to 4, and 6.

Another alternative for the divider device 50 wherein both the extension beam 85 and the flange 150 have a stiffness 285 about one ounce force per inch in a plane formed by the longitudinal 90 and tangential 95 axes to operationally allow a varying arcuate shape 215 to maintain the removable engagement 206, see FIG. 1, via the outer periphery 170 not buckling, wherein buckling the outer periphery 170 would cause the concave shape to be discontinuous along the longitudinal axis 90, wherein the varying arcuate shape 215 further acts to better coalesce 80 the article 65 against the surface 55, see FIGS. 8 and 9.

A next further alternative for the divider device 50 wherein both the extension beam 85 and the flange 150 have a stiffness 290 about two ounces force per inch in a plane formed by the longitudinal 90 and projection axes 100 to operationally allow a varying surface 55 shape to maintain the removable engagement 206, again see FIG. 1, such that the extension beam will still form an adequate barrier as between the articles 65, see FIGS. 8 and 9 while accommodating the varying surface 55 shape, see FIG. 9, wherein too much stiffness 290 (too large of first distance 225) would not accommodate the varying surface 55 shape, while too little stiffness 290 would not form an adequate barrier (too small of first distance 225) as between the articles 55.

Note that for the general application the surface 55 can be any surface that is substantially smooth to enable the flexible flange 150 to have the aforementioned removable engagement 206 and for the particular application the surface 55 is a food plate surface 60 that are mostly inherently smooth and can have typically an upward curvature near an outer perimeter for retaining food items 70, 75, see FIG. 9. Further for the general application the divider device 50 retains the articles 65 which can be anything, however, for the specific application the articles 65 are food items and for purposes of clarity split into the first food item 70 and the different second food item 75.

Method of Use

A method of using the divider device 50 is disclosed for placement of the divider device 50 upon the food plate surface 60 to divide the first food item 70 from the different second food item 75, see in particular FIGS. 8 and 9. The method of use steps include firstly providing a divider device 50 as previously described. A second step of providing the food plate 60 with a smooth food surface, plus a third step of providing a pair of different food items notable a first food item 70 and a different second food item 75, for instance peas and macaroni respectively, again see FIGS. 8 and 9.

Continuing, a fourth step of pressing 200 manually the primary surface 175 into direct contact with the food plate surface 60, thus substantially flattening 205 the concave shape 185 as against the food plate surface 60 to form the removable engagement 206 as between the flange 150 and the food plate surface 60 thus forming the substantially fluid tight interface 210 between the flange 150 and the food plate surface 60, see in particular FIG. 8, plus FIG. 9. Thus the substantially fluid tight interface 210 extends 160 beyond the extension beam 85 first 125 and second 135 end portions along the longitudinal axis 90 and the flange 150 extending beyond the extension beam 85 first 140 and second 145 face portions, see FIG. 7 for the best structural view and FIGS. 8 and 9 for the divider device 50 installed views. Also optionally the primary surface 175 can be wetted with water to prior to pressing 200 to enhance the removable engagement 206 and for enhancing the substantial fluid tight 210 nature of the removable engagement 206.

Next, a fifth step of placing 295 the first food item 70 to be disposed within the arcuate shape 215 of the divider device 50 on the food plate surface 60, again see FIGS. 8 and 9. Further, a sixth step of placing 300 the second food item 75 to be disposed outside the arcuate shape 215 of the divider device 50 on the food plate surface 60, thus to help prevent the first food item 70 from communicating to the second food item 75 and vice versa, via the extension beam 85 and the flange 150 being substantially fluid tight 210 to the food plate surface 60, again see FIGS. 8 and 9.

As an additional alternative to the method of using the divider device 50 wherein the flexible flange 150 secondary surface 180 further comprises the protrusion 265, see FIGS. 1 to 4, 6, and 9, wherein the protrusion 265 is operational to facilitate an added step of grasping 270 manually the protrusion 265 to have a pull movement 275 on the protrusion 265 to remove the flexible flange 150 by disengagement of the removable engagement 206 from the food plate surface 60 thus removing the divider device 50 easily from the food plate surface 60.

CONCLUSION

Accordingly, the present invention of a divider device has been described with some degree of particularity directed to the embodiments of the present invention. It should be appreciated, though; that the present invention is defined by the following claim construed in light of the prior art so modifications or changes may be made to the exemplary embodiments of the present invention without departing from the inventive concepts contained therein.

The invention claimed is:

1. A divider device for placement upon a surface to divide a pair of different articles, said divider device comprising:

(a) an extension beam having a longitudinal axis, said extension beam also having a tangential axis that is perpendicularly positioned to said longitudinal axis, further said extension beam having a projection axis that is perpendicularly positioned to said tangential axis, said extension beam additionally including a proximal end portion and an opposing distal end portion with said projection axis spanning therebetween, further said extension beam having a first end portion and an opposing second end portion with said longitudinal axis spanning therebetween and said extension beam also having a first face portion and an opposing second face portion with said tangential axis spanning therebetween; and (b) a flexible flange extending from said proximal end portion, said flexible flange extends parallel to both said longitudinal and tangential axes such that said flexible flange further has an extension in an outward manner that extends omni-directionally beyond said extension beam to terminate in an outer periphery relative to said proximal end portion, said flange having a primary surface oppositely positioned to said extension beam, said flange also having a secondary surface that is oppositely positioned to said primary surface, said primary surface having a concave shape that is juxtaposed to both of said tangential and longitudinal axes, wherein said concave shape forms an elongated depression trough that is elongated along said longitudinal axis, wherein operationally said primary surface is pressed into direct contact with the surface, thus substantially flattening said concave shape as against the surface to form a removable engagement as between said flange and the surface thus forming a substantially fluid tight interface between said flange and the surface that extends beyond said extension beam first and second end portions along said longitudinal axis and said flange extending beyond said extension beam said first and second face portions to help prevent a one of the articles from communicating between said extension beam, said flange, and the surface to another article on the surface that is disposed opposite of the other article in relation to the extension beam.

2. A divider device according to claim 1 wherein said longitudinal axis has an arcuate shape wherein said extension beam has an arcuate shape and said flexible flange also follows said extension beam arcuate shape such that said divider device has an arcuate shape along said longitudinal axis further resulting in said elongated depression trough having an annular shape, wherein operationally said arcuate shape of said extension beam and said flexible flange further helps the article maintain a coalesced shape as against said extension beam, said flexible flange, and the surface.

3. A divider device according to claim 1 wherein said extension beam has an aspect ratio of about eight percent (8%) being defined as a first distance between said proximal end portion and said distal end portion in relation to a second distance between said first and second end portions to operationally divide the pair of articles while not forming an obstructive barrier between the pair of articles.

4. A divider device according to claim 3 wherein said flexible flange outward manner extension is defined by a peripheral elongated continuous third distance omni-directionally emanating from said proximal end portion that is at least seventy percent (70%) of said first distance to provide an adequate surface area of said primary surface for said removable engagement.

5. A divider device according to claim 4 wherein said flexible flange has a tapering fourth distance as between said primary and secondary surfaces that is about twenty percent (20%) of said third distance at said proximal end portion to about six percent (6%) of said third distance at said outer periphery to accommodate said flattening of said concave shape.

6. A divider device according to claim 5 wherein said outer periphery is formed from a first full radius disposed as between said primary and secondary surfaces that is about three percent (3%) of said third distance to operationally give adequate rigidity to said outer periphery to help said removable engagement.

7. A divider device according to claim 6 wherein said concave shape is formed from a second radius that is about three times (3×) of said third distance to operationally help said removable engagement.

8. A divider device according to claim 7 wherein said concave shape has a mirror polish surface finish of no more than about one micro meter (1 μm) average roughness (Ra) to further accommodate said removable engagement.

9. A divider device according to claim 8 wherein said flexible flange has a hardness of about Shore A scale forty to forty five (40-45) to further accommodate said removable engagement.

10. A divider device according to claim 9 wherein said divider device is constructed of a one piece silicone with said extension beam and said flange being integral to one another.

11. A divider device according to claim 9 wherein said flexible flange secondary surface further comprises a protrusion that is operational to provide a manual grasping point to remove said flexible flange from the surface.

12. A divider device according to claim 9 wherein said primary surface has a flat portion that is adjacent to said outer periphery, said flat portion is about six percent (6%) of said third distance at said outer periphery wherein said flat portion is positioned inward from said outer periphery to further accommodate said removable engagement.

13. A divider device according to claim 2 wherein both said extension beam and said flange have a stiffness about one ounce force per inch in a plane formed by said longitudinal and tangential axes to operationally allow a varying arcuate shape to maintain said removable engagement.

14. A divider device according to claim 2 wherein both said extension beam and said flange have a stiffness about two ounces force per inch in a plane formed by said longitudinal and projection axes to operationally allow a varying surface shape to maintain said removable engagement.

15. A divider device for placement upon a food plate surface to divide a first food item from a different second food item, said divider device comprising:

(a) a flexible extension beam having a longitudinal axis, said extension beam also having a tangential axis that is perpendicularly positioned to said longitudinal axis, further said extension beam having a projection axis that is perpendicularly positioned to said tangential axis, said extension beam additionally including a proximal end portion and an opposing distal end portion with said projection axis spanning therebetween, further said extension beam having a first end portion and an opposing second end portion with said longitudinal axis spanning therebetween and said extension beam also having a first face portion and an opposing second face portion with said tangential axis spanning therebetween, said extension beam having an arcuate shape along said longitudinal axis wherein said extension beam arcuate shape is formed in a plane defined by said longitudinal and said tangential axes; and (b) a flexible flange extending from said proximal end portion, said flexible flange extends parallel to both said longitudinal and tangential axes such that said flexible flange further has an extension in an outward manner that extends omni-directionally beyond said extension beam to terminate in an outer periphery relative to said proximal end portion, said flange having a primary surface oppositely positioned to said extension beam, said flange also having a secondary surface that is oppositely positioned to said primary surface, said primary surface having a concave shape that is juxtaposed to both of said tangential and longitudinal axes, wherein said concave shape forms an elongated depression trough that is elongated along said longitudinal axis, said flexible flange following said flexible extension beam arcuate shape resulting in an annular shape for said elongated depression trough, wherein said concave shape has a mirror polish surface finish of no more than about one micro meter (1 μm) average roughness (Ra), wherein operationally said primary surface is pressed into direct contact with the food plate surface, thus substantially flattening said concave shape as against the food plate surface to form a removable engagement as between said flange and the food plate surface thus forming a substantially fluid tight interface between said flange and the food plate surface, thus the substantially fluid tight interface extends beyond said extension beam first and second end portions along said longitudinal axis and said flange extending beyond said extension beam said first and second face portions to help prevent the first food item from communicating to the second food item and vice versa, via said extension beam and said flange being substantially fluid tight to the food plate surface, wherein said arcuate shape helps to coalesce the food item.

16. A divider device according to claim 15 wherein said flexible flange has a hardness of about Shore A scale forty to forty five (40-45) to further accommodate said removable engagement.

17. A divider device according to claim 15 wherein said flexible flange secondary surface further comprises a protrusion that is operational to provide a manual grasping point to remove said flexible flange from the food plate surface.

18. A divider device according to claim 15 wherein said divider device is constructed of a one piece silicone with said extension beam and said flange being integral to one another.

19. A method of using a divider device for placement upon a food plate surface to divide a first food item from a different second food item, comprising the steps of:

(a) providing a divider device that includes a flexible extension beam having a longitudinal axis, said extension beam also having a tangential axis that is perpendicularly positioned to said longitudinal axis, further said extension beam having a projection axis that is perpendicularly positioned to said tangential axis, said extension beam additionally including a proximal end portion and an opposing distal end portion with said projection axis spanning therebetween, further said extension beam having a first end portion and an opposing second end portion with said longitudinal axis spanning therebetween and said extension beam also having a first face portion and an opposing second face portion with said tangential axis spanning therebetween, said extension beam having an arcuate shape along said longitudinal axis wherein said extension beam arcuate shape is formed in a plane defined by said longitudinal and said tangential axes, a flexible flange extending from said proximal end portion, said flexible flange extends parallel to both said longitudinal and tangential axes such that said flexible flange further has an extension in an outward manner that extends omni-directionally beyond said extension beam to terminate in an outer periphery relative to said proximal end portion, said flange having a primary surface oppositely positioned to said extension beam, said flange also having a secondary surface that is oppositely positioned to said primary surface, said primary surface having a concave shape that is juxtaposed to both of said tangential and longitudinal axes, wherein said concave shape forms an elongated depression trough that is elongated along said longitudinal axis, said flexible flange following said flexible extension beam arcuate shape resulting in an annular shape for said elongated depression trough, wherein said concave shape has a mirror polish surface finish of no more than about one micro meter (1 μm) average roughness (Ra);

(b) providing a food plate with a smooth food surface;

(c) providing a pair of different food items;

(d) pressing manually said primary surface into direct contact with the food plate surface, thus substantially flattening said concave shape as against the food plate surface to form a removable engagement as between said flange and the food plate surface thus forming a substantially fluid tight interface between said flange and the food plate surface, thus the substantially fluid tight interface extends beyond said extension beam first and second end portions along said longitudinal axis and said flange extending beyond said extension beam said first and second face portions;

(e) placing the first food item to be disposed within said arcuate shape of said divider device on the food plate surface; and (f) placing the second food item to be disposed outside said arcuate shape of said divider device on the food plate surface, thus to help prevent the first food item from communicating to the second food item and vice versa, via said extension beam and said flange being substantially fluid tight to the food plate surface.

20. A method of using a divider device according to claim 19 wherein said flexible flange secondary surface further comprises a protrusion that is operational to facilitate an added step of grasping manually said protrusion to have a pull movement on said protrusion to remove said flexible flange by disengagement of said removable engagement from the food plate surface thus removing said divider device from the food plate surface.

* * * * *